US008933866B2

(12) United States Patent
Lai

(10) Patent No.: US 8,933,866 B2
(45) Date of Patent: Jan. 13, 2015

(54) ACTIVE MATRIX PIXEL BRIGHTNESS CONTROL

(75) Inventor: Jackson Chi Sun Lai, Mississauga (CA)

(73) Assignee: BlackBerry Limited, Waterloo, Ontario (CA)

( * ) Notice: Subject to any disclaimer, the term of this patent is extended or adjusted under 35 U.S.C. 154(b) by 105 days.

(21) Appl. No.: 13/592,650

(22) Filed: Aug. 23, 2012

(65) Prior Publication Data

US 2014/0055326 A1 Feb. 27, 2014

(51) Int. Cl.
*G09G 3/30* (2006.01)

(52) U.S. Cl.
USPC ..... 345/77; 345/76; 315/169.3

(58) Field of Classification Search
CPC ..... G09G 3/3233; G09G 2310/0251; G09G 2310/0259
USPC ..... 345/76–83; 315/169.3
See application file for complete search history.

(56) References Cited

U.S. PATENT DOCUMENTS 8,269,698 B2 * 9/2012 Lee et al. ..... 345/76
2005/0062106 A1 3/2005 Noguchi et al.
2007/0008297 A1 1/2007 Bassetti
2009/0167649 A1 * 7/2009 Ishizuka ..... 345/80
2012/0044231 A1 2/2012 Park
2012/0188221 A1 * 7/2012 Izawa et al. ..... 345/212

OTHER PUBLICATIONS

Partial European Search Report dated Jan. 15, 2013 for European Patent Application No. 12181597.1.
Extended European Search Report dated Apr. 22, 2013 for European Patent Application No. 12181597.1.

* cited by examiner

*Primary Examiner* — Dmitriy Bolotin
(74) *Attorney, Agent, or Firm* — Jeffrey N. Giunta; Fleit Gibbons Gutman Bongini & Bianco P.L.

(57) ABSTRACT

A multiple pixel display and method of driving same. Each pixel in the display has a light emitting element and a drive current controller. A control terminal of the drive current controller receives an intensity control input and drives the light emitting element with an amount of electrical current based upon the intensity control input. Each pixel also has a voltage storage device that is charged with a programmed voltage between with a first terminal that is electrically coupled to the control terminal, and a second terminal that is electrically opposite the first terminal of the voltage storage device. An intensity reduction input of each pixel is electrically coupled to the second terminal of the voltage storage device and to respective intensity reduction inputs of other pixels within the plurality of pixels.

18 Claims, 8 Drawing Sheets

ACTIVE MATRIX PIXEL BRIGHTNESS CONTROL

FIELD OF THE DISCLOSURE

The present disclosure generally relates to electronic displays, and more particularly to adjusting brightness in active matrix displays.

BACKGROUND

Advancements in the design of Organic Light Emitting Diode (OLEDs) displays, such as Active Matrix OLED (AMOLED) displays, have resulted in an increase in the variety of applications that incorporate such display technology. Unlike many other types of displays, such as conventional backlit LCD designs, AMOLED devices include light emitters in each individual pixel and require no backlight. These individual pixels emit light with intensity according to a value programed into that pixel, which causes a proportional electrical current to be supplied to the in-pixel OLED device. This OLED current ($I_{OLED}$) is controlled by circuits associated with each pixel, which may include one or more thin film transistors. (TFT). In other types of displays that use a backlight to create the light that is emitted by the display, the display brightness is able to be easily adjusted by simply changing the intensity of light emitted by the backlight of the display. In contrast to adjusting one brightness value that controls the backlight intensity for the entire display, adjustment of brightness in an AMOLED display is accomplished by modifying the intensity of light emitted by each OLED element in the display.

Controlling display brightness is often used to control power consumption, whereby the brightness of light emitted by the display is varied in response to ambient light brightness and also in response to the content that is being displayed. In displays with a common backlight, such as conventional Liquid Crystal Displays (LCDs), algorithms such as content aware brightness/backlight control (CABC) reduce power consumption by determining limits on pixel brightness based upon an analysis of the data defining all of the pixels of the displayed image. In general, displays with content aware brightness control (CABC) are controlled by pulse with modulation (PWM) of the backlight based upon an analysis of the backlight brightness required by the image being presented on the display.

The brightness of an entire AMOLED display is able to be controlled globally by controlling the time that each pixel emits light, which is referred to as "emission time," or by controlling, e.g., limiting, the electrical current delivered to the pixel OLED element during the emission time. Limiting emission time is able to reduce pixel brightness by shortening the duration by which all elements of the OLED display are in a light emission phase. In one example, a switch is placed between the drive transistor of the pixel and the OLED element of the pixel opens after the display has been configured to have each element emit light at its programmed intensity. That is to say, the switch, which is able to be implemented as a Thin Film Transistor (TFT), is pulsed and the OLED element will only emit light when the switch is closed.

Lowering the brightness of all pixels of an AMOLED display is able to be performed by dynamically changing the voltages of the DC power or bias lines supplying all OLED pixel elements. In one example, the two polarities of direct current (DC) power lines supplying power to the pixels of a display are indicated as EL_VDD and EL_VSS. Lowering the voltage between EL_VDD and EL_VSS causes a reduction in the voltage across the OLED pixel and thereby reduces the electrical current passing through the pixel and thereby lowers the brightness of the entire display.

In order to achieve desired aesthetics when performing the above described brightness control mechanisms, an analysis of the relationships of the intensity of each pixel in an image to be displayed is performed in order to determine an effective amount of overall display brightness reduction given the image data to be displayed. In general, specialized circuitry or other image processing resources are used to perform this image frame data analysis. Such additional processing adds complexity to the associated display driver or controller circuitry of a display.

Therefore, the operation of circuits used to reduce display brightness in active matrix displays with emissive pixel elements increases the cost and complexity of such circuits, thereby limiting the inclusion of energy conserving brightness control circuits in such displays.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present disclosure, in which.

DETAILED DESCRIPTION

Described below are examples of active matrix displays, such as Active Matrix Organic Light Emitting Diode (AMOLED) displays, that provide efficient and effective methods and systems for adjusting the brightness of light emitted by the display. The method and systems described below are applicable to any type of display device, such as portable electronic devices or larger display devices such as televisions. These systems and methods are able to be applied to small displays with a few pixels, or to large displays incorporating many pixels. These systems and methods are further able to be applied to displays that include monochrome pixels that emit narrow bandwidth light or light with broader spectral content, color pixels that each includes sub-pixels of two or more colors to synthesize a color image, or any other type of electrical displays.

Figure 1:
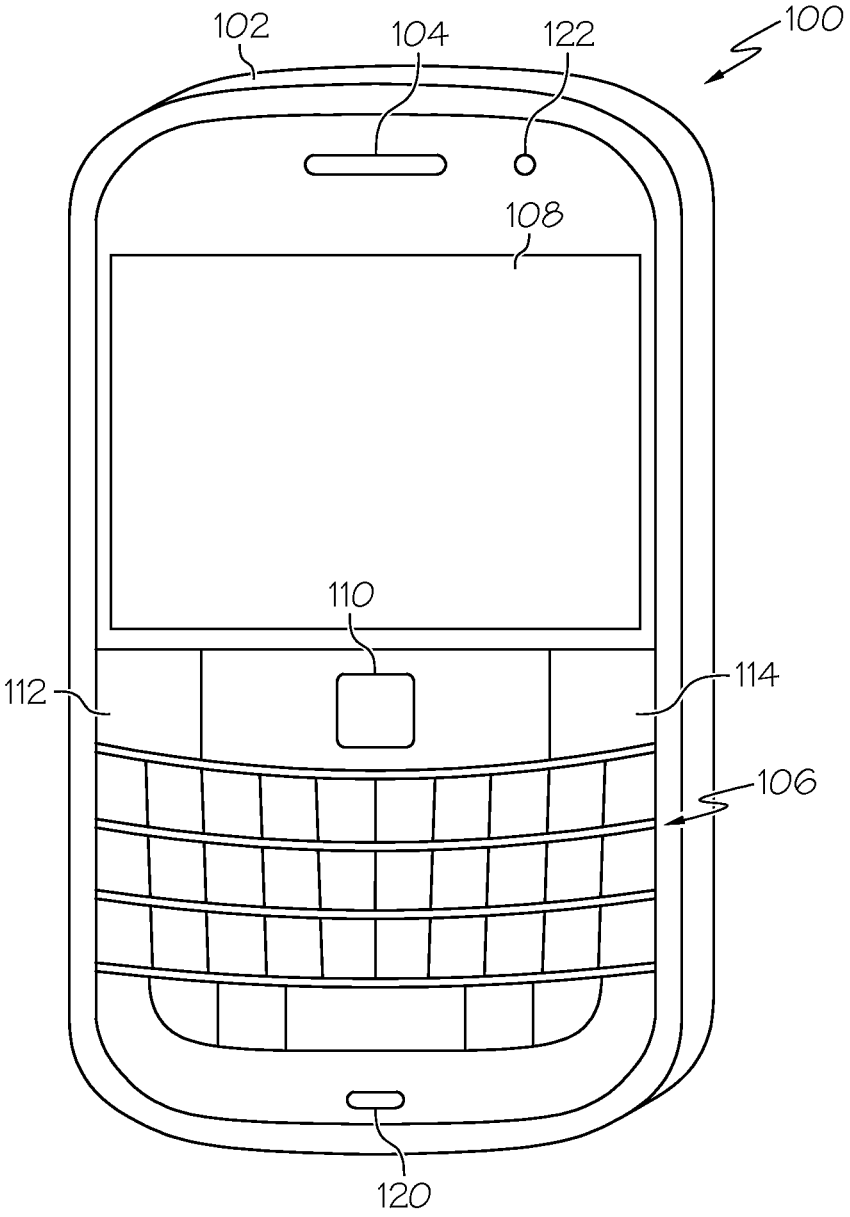
FIG. 1 illustrates a handheld communications device, according to one example.

FIG. 1 illustrates a handheld communications device 100, according to one example. The example handheld communications device 100 reflects an example of a portable electronic device 102, such as a Personal Digital Assistant (PDA), a smart-phone, a cellular telephone, a tablet computer, or any other type of portable electronic device. In general, a handheld device refers to any device that is sized, shaped and designed to be held or carried in a human hand. The portable electronic device 102 includes a wireless communications subsystem, described below, that is able to exchange voice and data signals. In one example, the wireless communications subsystem is able to receive a wireless signal conveying data tables to be displayed by the portable electronic device. The illustrated portable handset device is an example of an electronic device with an electronic display that incorporates brightness reducing mechanisms described below.

The portable electronic device 102 includes an earpiece speaker 104 that is used to generate output audio to a user engaged in, for example, a telephone call. A microphone 120 is able to receive audible signals, such as a user's voice, and produce an electrical signal representing the audible signal. The portable electronic device 102 further includes a keyboard 106 that allows a user to enter alpha numeric data for use by, for example, application programs executing on the portable electronic device.

The portable electronic device 102 further has a first selection button 112 and a second selection button 114. In one example, a user is able to select various functions or select various options presented on the display 108 by pressing either the first selection button 112 or the second selection button 114. In another example, the first selection button 112 and the second selection button 114 are associated with particular functions that are performed in response to pressing the respective button. The portable electronic device 102 also has a trackpad 110. Trackpad 110 is able to receive input indicating a direction or movement, a magnitude of movement, a velocity of movement, or a combination of these quantities, in response to a user moving a finger across the face of trackpad 110.

In further examples, a user is able to use various techniques to provide inputs that are received by a processor of the portable electronic device 102. For example, microphone 120 is able to receive audible voice commands uttered by a user and process those audible voice commands to create an input signal that are received by other processes to control further processing. A user is also able to use keyboard 106 to enter text based commands that a processor of the portable electronic device 102 interprets to produce inputs that are received by other processes to control further processing.

The illustrated portable electronic device 102 is also an example of an electronic display device. The illustrated portable electronic device 102 includes a display 108. The display 108 depicted in FIG. 1 is an Active Matrix Organic Light Emitting Diode (AMOLED) graphical alpha numeric display capable of displaying various images to a user. The display 108 in one example is a touchscreen user interface device that allows a user to touch the screen of the display 108 to select items and to perform gestures, such as swiping a finger across the screen of the display 108, to provide a user interface input to an application program operating on the portable electronic device 102. In response to a user's gesture, such as swiping, or moving, a finger touching the screen of the display 108 across the screen, the display 108 receives a user interface input that is associated with the gesture performed by the user.

The display 108 of one example includes the below described mechanisms that allow adjustment of the brightness of light emitted by the entire display, or part of the display, to be adjusted. The brightness of light emitted by the display is able to be adjusted by any technique, such as a user interface or in automatic response to, for example, ambient light detection. In the illustrated example, the portable electronic device 102 includes an ambient light detector 122 that is able to determine a level of ambient light. Indicators of ambient light levels are able to be provided to processing within the portable electronic device 102 to determine an amount of display brightness reduction, i.e., an amount of reduction in the light emitted by pixels of the display 108, that should be implemented on the display 108 based upon the brightness of the environment in which the portable electronic device 102 is being used. The portable electronic device 102 includes display pixel emitted light intensity reduction processing, as is described in detail below, to drive the display 108 and perform emitted light intensity reduction. In one example, an amount of display emitted light intensity reduction is able to be specified by a user input received through, for example, the above described user interface elements such as inputs received through the touch screen user interface device, trackpad 110, buttons, and the like.

Examples of the below described systems and methods include Active Matrix Organic Light Emitting Diode (AMOLED) displays, where each pixel in the display is provided with a light emission intensity value for that display. The light emission intensity value in one example is an electrical voltage driving a data input to the individual pixel. In an example, each pixel has a drive current controller, such as a thin film transistor (TFT), that drives an organic light emitting diode (OLED) element that is part of that pixel with an electrical current based upon the provided voltage level representing pixel intensity.

The below described systems and methods provide Active Matrix Organic Light Emitting Diode (AMOLED) display designs that include a number of pixels, where each pixel in a display or at least each pixel in a subset of pixels in the display is driven by a biasing signal, such as a biasing voltage, that is delivered to all pixels and that drives all pixels of the display in order to reduce the brightness of light emitted by the pixel. As described below, these pixels operate such that the amount of brightness reduction is not uniform for all pixels, but is proportional to the intensity level commanded for the pixel.

The below described examples operate displays that include Active Matrix Organic Light Emitting Diode (AMOLED) pixels. AMOLED pixels include individual light emitting elements in each pixel. Each pixel of an AMOLED display emits light based upon an amount of electrical current flowing through the OLED element of that pixel. Adjustment of brightness in an AMOLED display is different than in displays that produce emitted light based on a common backlight structure, such as conventional LCD displays. Reducing the observed brightness level of, for example, an entire conventional LCD display is achieved in one example by dimming the brightness of the backlight structure. This is generally achieved by a single control circuit that dims the backlight intensity and is able to be controlled by, for example, an analogy of a familiar brightness "knob" or other control that is present on various video display devices, such as television receivers.

Adjusting the level of the biasing signal, such as a biasing voltage, in the pixel circuits described below operates to reduce the brightness of the pixels in a manner similar to the single adjustment "knob" or control used on many video display devices. The proportional reduction in brightness based upon the variation of a biasing voltage that is realized on a pixel-by-pixel basis in the below described circuits allows for a more natural reduction in display brightness and better preserves the emitted intensity of dim pixels in an image while reducing the emitted intensity of bright pixels in the image. As described below, the use of a biasing signal that is delivered to all pixels simplifies the circuitry used to implement the overall display brightness reduction and obviates a need for image frame analysis to determine display brightness reduction. The use of a single biasing signal to reduce the overall display brightness by proportionately reducing pixel brightness further obviates processing to adjust the brightness command data provided to each pixel to implement the display brightness reduction. Such simplifications reduce circuit complexity and costs and allows the more efficient realization of AMOLED displays with effective display brightness reduction capabilities.

The systems and methods described below provide many advantages over brightness reduction techniques used in conventional AOLDED displays. The below described systems and methods provide a brightness reduction technique that does not perform any analysis of displayed image data and does not apply any changes to the image data that is delivered to a display controller that programs the pixels of the display. This lack of image processing and modification of image data allows provides for a reduced physical circuit size and improves system reliability by, for example, reducing circuit complexity due to the absence of image processing hardware, and by reducing heat that would be otherwise generated and require dissipation within the system the image processing hardware used by conventional AMOLED display brightness reduction circuits. The lack of image processing hardware further reduces electrical consumption by the display while providing an effective brightness reduction technique. The below described systems and methods further implement an effective brightness reduction capability with little impact on the individual pixel designs.

The brightness reduction techniques described herein are able to be applied to a wide variety of displays. In addition to AMOLDED displays used in portable electronic devices, the below described techniques are applicable to various types of displays and other light emitting devices where a bias voltage is able to be applied to the individual pixels of the display. Various active matrix display devices used in many applications, such as video display monitors, alpha-numeric displays, device indicators, device data output displays, and touchscreen control inputs are a few examples of devices that are able to incorporate the brightness reducing techniques described herein.

Figure 2:
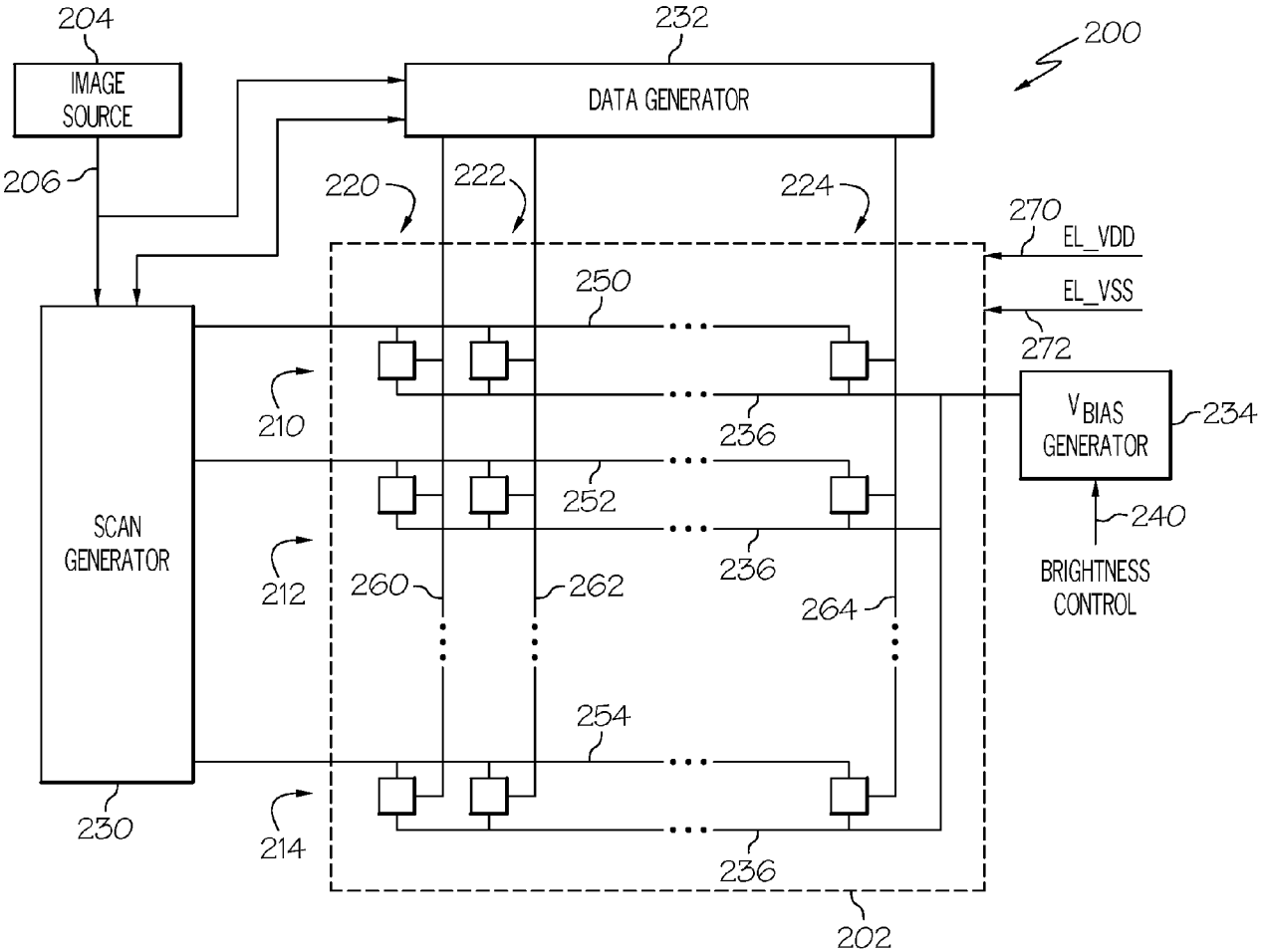
FIG. 2 illustrates an Active Matrix Organic Light Emitting Diode (AMOLED) display component diagram, according to one example.

FIG. 2 illustrates an Active Matrix Organic Light Emitting Diode (AMOLED) display component diagram 200, according to one example. The AMOLED display component diagram 200 illustrates components of an AMOLED display that are relevant to the description of the below described examples. The AMOLED display component diagram 200 illustrates components of an electronic display that is included, for example, on an electronic device, such as the display 108 discussed above.

The AMOLED display component diagram 200 depicts a pixel array 202 that represents the many pixels of a display. A first pixel row 210, a second pixel row 212, and an $n^{th}$ pixel row 214 are shown. The pixel array 202 further illustrates a first pixel column 220, a second pixel column 222, and an $m^{th}$ pixel column 224. In general, an AMOLED display is able to have any number of rows and columns of pixels. In this illustration, only a few pixels are represented in order to more clearly present the important details of the illustrated example and to facilitate the description of the design and operation of this example.

The AMOLED display component diagram 200 depicts an image source 204 that supplies data defining images to be displayed on the pixel array 202. Examples of images supplied by the image source 204 include pictures of images to be displayed, frames of movies that are to be displayed, user interface or other computer generated screens to display to a user, or any other type of image that is presented on the pixel array 202. The image data supplied by the image source 204 is provided to a scan generator 230 and a data generator 232.

The pixel array 202 in this example is an active matrix array of pixels, where each pixel has active electronic components, such as one or more transistors, that potentially operate with other passive components to store a light intensity level to be produced by that pixel when displaying an image. As is described in detail below, one example sequentially programs the pixels of each row of pixels in the pixel array 202 with light intensity values that correspond to the intensity to be emitted by those pixels for the image to be displayed. In this illustration, ellipses, or dots, are used to represent a number of pixels, in either the vertical or horizontal direction, that are present in the display array but not explicitly shown in each row and column of the display.

The data generator 232 receives data defining images to be displayed and determines a voltage level to be programmed into each pixel of the pixel array 202 to display that image. The data generator 232 produces one output for each row of pixels in the pixel array 202. In general, the data generator 232 produces voltages on a separate line for each pixel in the first row of the pixel array 202, followed by voltages on each of those separate lines for each pixel in the second row, followed by a sequence of voltages on those separate lines for each pixel in all M rows of the pixel array 202. In the illustrated example, a first data line 260, a second data line 262 and an $M^{th}$ data line 264 are shown to each connect to all pixels in a respective column of the pixel array 202. In this illustration, dotted lines represent the continuation of a line though areas not explicitly shown, such as areas of pixels not shown in the pixel array 202.

The scan generator 230 operates in concert with the display generator to sequentially assert, e.g., indicate an active or "on" level, a scan line for each row of the pixel array 202. When the scan line for a particular row of the pixel array is asserted, the voltage on each of the data lines produced by the data generator 232 is programmed into the respective pixel of that row. As the data generator 232 sequentially produces the voltage levels to be programmed into the pixels of the succeeding rows, the scan generator 230 asserts the scan line for the row of pixels to be programmed with the voltages present on the data lines produced by the data generator 232. In the illustrated example, a first row scan line 250, a second row scan line 252 and an $N^{th}$ row scan line 254 are shown to each connect to all pixels in a respective row of the pixel array 202.

In one example, the programming of the active matrix elements of the pixel array 202 occurs during a first time interval, referred to herein as a programing time interval, that is associated with the display of each image. An emission time interval in one example follows the programming time interval and is a period during which all pixels of the pixel array emit light with an intensity based upon the programmed intensity. In the illustrated example, a power supply with two lines, an EL_VDD line 270 and an EL_VSS line 272, provide the pixels with electrical power consumed by the OLED elements of each pixel when emitting the specified level of light intensity.

The above described data lines and scan lines are similar to control structures found in some conventional types of active matrix displays. In addition to those data lines and scan lines, the illustrated AMOLED display component diagram 200 further includes a V_cap_bias line 236 that connects a bias voltage generated by a Vbias generator 234 to a respective intensity reduction input of each pixel in the pixel array 202. The Vbias generator 234 receives a brightness reduction level input via a brightness control and, based on the brightness reduction level input, produces a voltage waveform during the time intervals in which the pixels of the pixel array 202 are configured to emit light. The Vbias generator 234 of one example produces a bias voltage that, in one example, is a single voltage output that is delivered to the intensity reduction input of each pixel in the pixel array 202 by a V_cap_bias line 236 in order to reduce the emitted light intensity of each pixel as described below. In the illustrated example, the V_cap_bias line 236 is a single conductive path that connects to a respective intensity reduction input port of each pixel in the pixel array 202.

Figure 3:
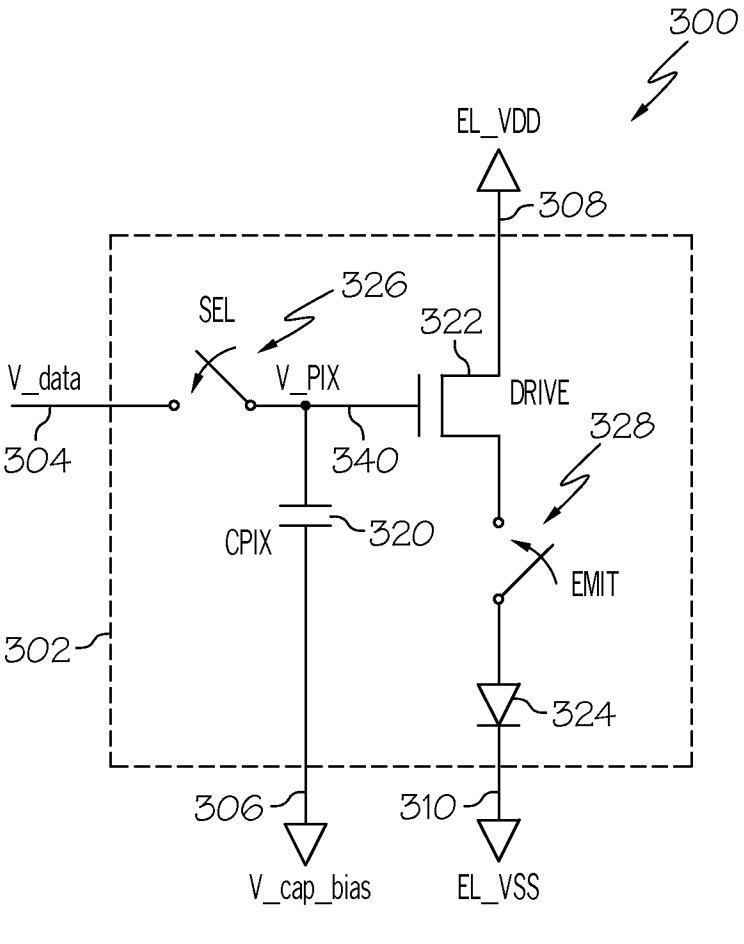
FIG. 3 illustrates an Active Matrix Organic Light Emitting Diode (AMOLED) display pixel circuit diagram, according to one example.

FIG. 3 illustrates an Active Matrix Organic Light Emitting Diode (AMOLED) display pixel circuit diagram 300, according to one example. As is described below, the AMOLED display pixel circuit diagram 300 depicts an example design of one respective pixel that is included within a multiple pixel AMOLED display, such as is described above with regards to the AMOLED display component diagram 200 discussed above. In the following discussion, the individual light emitting elements and the circuitry associated with each light emitting element is referred to as a "pixel." As described above, a display array generally includes a number of pixels that have similar or generally identical designs. In the following descriptions, the components of a particular pixel are referred to as "respective" elements to identify the individual components of an individual pixel within the pixel array. In various examples, a pixel array 202 is able to reduce the emitted intensity of each pixel in the pixel array 202, or further examples are able to reduce the emitted intensity of only a subset of fewer than all of the pixels of the pixel array 202. In such as further example, the pixels within the subset of fewer than all of the pixels of the pixel array 202 have circuit configurations such as depicted for the AMOLED display pixel circuit diagram 300 while other pixels are able to have other configurations that may not include intensity reduction inputs.

The AMOLED display pixel circuit diagram 300 depicts an Organic Light Emitting Diode (OLED) element 324, that is connected in series with an EMIT switch 328 and a drive transistor 322 between a EL_VDD power line 308 and an EL_VSS power line 310. In one example, the EMIT switch 328 and the drive transistor 322 of each pixel circuit are implemented as respective Thin Film Transistors (TFT) formed within the structure of the entire display that contains many copies of the illustrated pixel. In one example, the drive transistor 322 is implemented as a P-channel Field Effect Transistor (FET) and is a respective thin film transistor fabricated adjacent to the light emitting element with a respective gate coupled to respective series combination of a respective voltage storage device, which is CIPX capacitor 320 in the illustrated example, charged with the programmed voltage, and the intensity reduction input voltage that is received via the V_cap_bias 306.

The drive transistor 322 is an example of a drive current controller for an OLED element that operates to control a respective amount of electrical current that drives a respective OLED element 324. The drive transistor 322 of a particular pixel has a respective gate terminal that is an example of a control terminal for the drive transistor 322. The amount of the constant electrical current provided by the drive transistor 322 is based upon a voltage on the gate of the drive transistor 322. The voltage on the gate of the drive transistor is an example of an intensity control input to the drive transistor 322, which is a drive current controller in this example.

As is understood by practitioners of ordinary skill in the relevant arts, active matrix displays are able to divide operations performed to display an image into operations that are each performed during one of two separate time durations. A first time duration of these two time durations is a programming time duration. During the programming time duration, pixel intensity levels are programmed into the pixel. In one example, the intensity level is programmed by charging the CPIX capacitor 320 with a voltage that indicates the intensity of light to be emitted by that pixel, as is described below. After the programming time duration, an emission time duration occurs during which the pixel operates to emit light at an intensity level that is based upon the programmed intensity level set during the programming time duration. In the illustrated example, the light intensity emitted by a pixel during the emission time duration is able to be modified by, for example, display brightness reduction processing that includes conventional techniques in addition to the techniques described below.

In many conventional Liquid Crystal Displays (LCDs) and Active Matrix Organic Light Emitting Diode (AMOLED) displays, as well as other types of active matrix displays in general, the programming of each row (or column) is alternated with configuring that row to emit light at the programmed intensity level while the next row is programmed. For example, the operation of a conventional AMOLED display programs each pixel in a first row of the display with its programmed intensity level and then configures that row of pixels to emit light at the programmed intensity level while each pixel in a second row of that display is programmed with their respective programmed intensity values. Such alternating between programming one row while a previously programmed row emits light continues as all rows of the display are programmed and configured to emit light is often performed in convention active matrix displays.

As is described in further detail below, a controller of one example of the system and methods described herein programs all pixel of a display with their programmed intensity level prior to configuring all pixels to emit light at their programmed intensity levels. In one example, the pixels of each row of the display are sequentially programmed with their programmed intensity levels until all rows are programmed, then all pixels of the display are configured to emit light during an emission time duration.

In the illustrated example, the gate of drive transistor 322 is connected to a V_PIX line 340. The V_PIX line 340 is also connected to a first terminal of a CPIX capacitor 320. A second terminal of the CPIX capacitor 320 is on an opposite end of the CPIX capacitor 320 and is connected to a V_cap_bias line 306. The CPIX capacitor 320 is an example of a respective voltage storage device of a particular pixel, where the respective voltage storage device is charged with a programmed voltage between its first terminal and its second terminal. As is described in further detail below, the V_cap_bias line 306 is generally held at a low level, or a ground level, referred to as a baseline voltage level during the programming duration in one example. A SEL switch 326 connects the V_PIX line 340 to the V_data line 304. The V_data line 304 is a pixel intensity programming line that conveys an intensity control input for the pixels in the form of a programming voltage to be charged onto the CPIX capacitor 320. In one example, all of the V_data lines 304 of all of the pixels in a given column are connected together. The SEL switch 326 is connected in one example to a row select line, or row scan line, thereby closing when the intensity value for the particular row is present on the V_data line 304. In one example, the SEL switch 326 is a TFT transistor that conducts when the row scan line for the row of that pixel is asserted. When the SEL switch 326 conducts, the CPIX capacitor 320 is charged to a voltage level based upon the pixel intensity voltage, i.e., the programmed voltage, that is present on the V_data line 304. In general, the voltage to which the CPIX capacitor 320 is charged is able to be less than the voltage on the V_data line 304 due to, for example, losses through the SEL switch 326. After the CPIX capacitor 320 is charged to a voltage representing the intensity that the particular pixel is to emit, the SEL switch 326 opens and the voltage across the CPIX capacitor 320 remains. The gate of the drive transistor 322, which is an example of a control terminal of the drive current controller, is electrically connected to the first terminal of the CPIX capacitor 320 by the V_PIX line 340 in this example.

Once all pixels have been configured with the intensity that each pixel is to emit, the EMIT switch 328 of all pixels is opened and an electrical current flows through the drive transistor 322 to cause the OLED element 324 to emit the specified light intensity. In one example, the drive transistor 322 is a P-Channel FET varies the amount of electrical current provided to the OLED element 324 when the EMIT switch 328 in reverse proportion to the voltage difference between the voltage on the gate of the drive transistor 322, which is equal to the voltage on the V_PIX line 340, and the voltage on the source of the drive transistor 322, which is based upon EL_VSS 310 less the voltage drop across the OLED element 324. Such operation is an example of the P-Channel FET varying the amount of electrical current provided to the OLED element 324 in reverse proportion to an intensity control input. Because the drive transistor 322 is a P_Channel FET and the pixel circuit has the illustrated configuration, higher voltages present on the V_data line 304, which is also the voltage charged across the CPIX capacitor 320, indicate a lower emitted light intensity for that pixel. Conversely, lower voltages on the V_data line 304, which is also the voltage charged across the CPIX capacitor 320, indicate a higher emitted light intensity for that pixel.

As discussed in detail below, the brightness of all pixels in a display is reduced in one example by increasing the voltage present on the V_cap_bias line 306 during the emission time duration. As the voltage present on the V_cap_bias line 306 increases, the voltage across the CPIX capacitor 320 remains the same and the voltage difference between the V_PIX line 340 and EL_VSS 310, which is the voltage between the gate and source ($V_{gs}$) of the drive transistor 322 less the voltage drop across the OLED element 324, increases. As $V_{gs}$ increases, the electrical current that passes through the drive transistor 322, which is a P-Channel FET, decreases resulting in a corresponding decrease in the intensity of light emitted by the OLED element 324 of that pixel. The voltage present on the V_cap_bias line 306 is an example of an intensity reduction control voltage that is used to cause a proportional reduction in the intensity of light emitted by all pixels.

As described below, the lower the value of the voltage across the CPIX capacitor 320 prior to increasing the voltage of V_cap-bias 306, the lower the initial voltage of $V_{gs}$ and the greater the decrease in electrical current that is provided to the OLED element 324 as V_cap_bias increases. Conversely, a higher value of voltage across VPIX during the emission time duration results in a higher initial $V_{gs}$ and a correspondingly lower amount of decrease of electrical current provided to the OLED element 324 as V_cap_bias is increased, thereby causing less brightness reduction for pixels that are programed with a lower intensity value, i.e., higher programmed voltage across the CPIX capacitor 320, relative to pixels that are programmed with a higher intensity value, i.e., lower programmed voltage across the CPIX capacitor 320.

Figure 4:
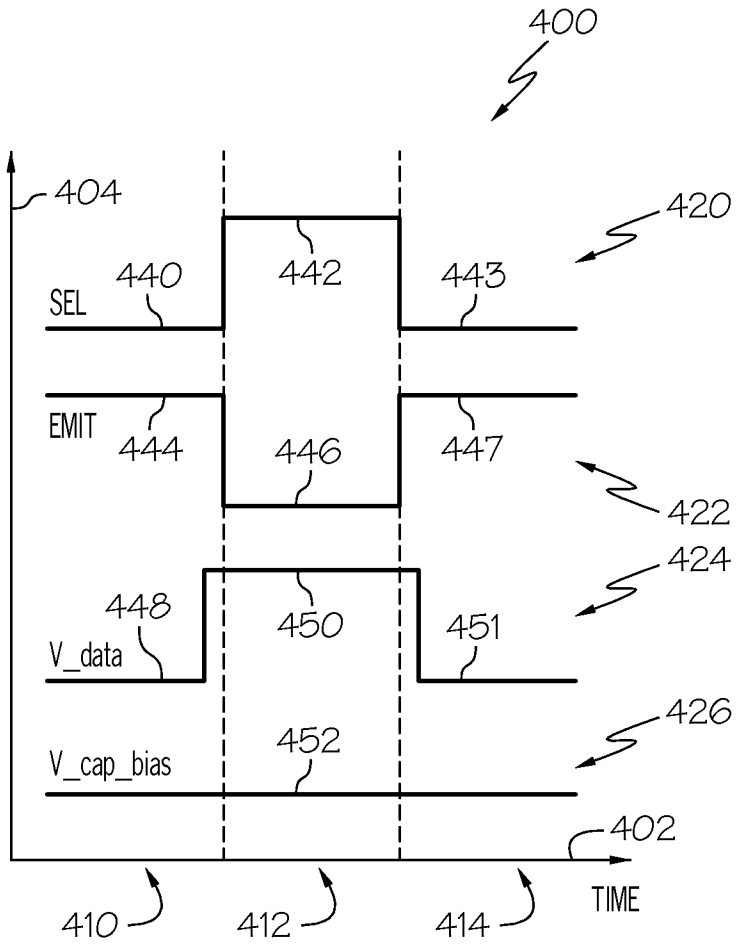
FIG. 4 illustrates a programming time interval signal timing diagram, according to one example.

FIG. 4 illustrates a programming time interval signal timing diagram 400, according to one example. The programming time interval signal timing diagram 400 depicts the levels of several control signals before, during and after the programming time interval of a particular pixel. In order to simplify the description of relevant operations of the operation of a pixel in this example, the signal levels for the operation of only one pixel is shown. In most displays, a number of pixels are arranged in a one dimensional arrangement or in a two dimensional array. These displays operate by programming one or more pixels during a particular time duration. For example, one type of multiple pixel display design programs all pixels in a particular row at one time, and sequentially programs the pixels of the different rows during separate time durations.

In this description, signal timing diagrams are described in the context of displaying a sequence of images on a display, where each image in the sequence is displayed immediately after a preceding image in the sequence. The following description refers to signal levels and conditions that exist prior to the processing used to display a particular image on the display. It is to be noted that similar signal timing levels and relationships are able to be used to configure the display for the first image to be displayed in the sequence.

The nomenclature used in this description of the programming time interval signal timing diagram 400 shares terms used above with regards to the AMOLED display pixel circuit diagram 300 and the operating concepts described below refer to the circuit structure depicted in FIG. 3. It is to be understood that the concepts described with regards to the several following signal timing diagrams are also applicable to different circuit structures. During the illustrated programming interval, the intensity of light to be emitted by that pixel is programmed into the pixel, such as by charging the CPIX capacitor 320 of that pixel as is described above with regards to FIG. 3.

The programming time interval signal timing diagram 400 has a horizontal time axis 402 and a vertical level axis 404. The time axis 402 indicates progressive time for the depicted signals. The level axis 404 indicates levels of the depicted signals of this example. The magnitude and polarity of the various depicted signals in various examples depends upon the design and characteristics of pixel hardware used in those examples. In various examples, similar signals in those examples convey similar information and have similar responses to those described below.

The programming time interval signal timing diagram 400 illustrates an initial time interval 410, a programming time interval 412 and an emission time interval 414. The programming time interval signal timing diagram 400 depicts several signal levels during each of these intervals. The programming time interval signal timing diagram 400 depicts two control signals, a SEL control signal level 420, and an EMIT control signal level 422. With reference to FIG. 3, these control signal levels correspond to the signals controlling the SEL switch 326, and the EMIT switch 328, respectively. It is to be noted that the control signal levels depicted in the programming time interval signal timing diagram 400 are logic levels. A "low" level of a control signal depicted in the programming time interval signal timing diagram 400 indicates that the signal level is "false" or "un-asserted" and that the action being controlled is "off." In the example illustrated in FIG. 3, a low level of the control signal indicates that the associated switch is open, or off. A high signal level indicates that the switch is closed, or on. It is to be noted that actual voltage levels that are present on a particular control signal line are able to be different depending upon the design of the circuit receiving and processing those control signals, as is understood by practitioners of ordinary skill in the relevant arts.

The programming time interval signal timing diagram 400 further depicts two data signals, a V_data signal level 424 and a V_cap_bias signal level 426. With reference to FIG. 3, these data signal levels correspond to the voltages present on the V_data line 304 and the V_cap_bias line 306, respectively.

The illustrated initial time interval 410 in this example depicts the control signal levels that are present during an emission time interval of the preceding image frame. In general, the time interval before a programming time interval is also able to be a programming time interval for a different pixel, such as a pixel in a different row, a time interval when any other functions are performed, or a time interval where no functions are performed. In the illustrated initial time interval 410, the SEL control signal level 420 has an initial low level 440 and the EMIT control signal level 422 has an initial high level 444. The V_data signal 424 has an initial low level 448 and the V_cap_bias signal 426 has an initial low level 452 during the initial time interval 410.

It is noted that the data signals generally change levels prior to a control signal being asserted in order to ensure that the data signal is at its final level when its associated control signal is asserted. As depicted during the initial time interval 410, the V_data signal level 424 transitions from an initial low level 448 to a program level 450 prior to the start of the programming time interval 412. The program level 450 in this example is a programmed voltage for the pixel that represents a brightness to be emitted by this pixel. In the depicted programming time interval signal timing diagram 400, the SEL control signal level 420 is asserted at the start of the programming time interval 412. With reference to FIG. 3, it is noted that setting the SEL control signal level 420 to an asserted level, which results in closing of the SEL switch 326, causes the voltage on the V_data signal line 304, which is depicted as the V_data signal level 424, to be charged onto the CPIX capacitor 320.

The initial time interval 410 in this example corresponds to an emission time interval of the previous displayed image. The initial time interval 410 is therefore similar to the emission time interval 414 described below. The initial time interval indicates that the EMIT control signal 422 is in a high state, indicating that the pixel is to emit light. In further examples, a particular programming time interval is able to be preceded by other types of intervals, such as programming time intervals of other pixels, time intervals where other operations are performed, or any other type of time interval.

The programming time interval 412 follows the initial time interval 410 and is the time interval in which the pixel is programmed with the intensity level it is to emit in the subsequent emission time interval 414. Upon transitioning to the programming time interval 412, the SEL control line signal level 420 transitions from the initial low level 440 to the asserted level 442 and the EMIT control signal level 422 transitions from its initial high level 444 to its un-asserted level 446. With reference to FIG. 3, these control signal levels correspond to the SEL switch 326 being closed and the EMIT switch 328 being off. Further, the V_data signal level 424 is at a program level 450 and the V_cap_bias signal 426 remains at a low level during the programming interval 412. In this configuration, the voltage value on the V_data line 304, which is an example of a programmed voltage, is charged onto the CPIX capacitor 320. Because the EMIT control signal level 422 is low, the OLED element 324 is not emitting light.

In this description and illustration, the emission time interval 414 is shown to follow the programming time interval 412. In general and as is described in further detail below, a programming time interval for a particular row of a pixel array is able to be followed by programming time intervals used to program intensity levels for the pixels of other rows of the pixel array. In order to concisely describe the relationship between operations occurring during the pixel programming time interval and pixel emission time interval, these two time intervals are shown as immediately following one another.

Upon transitioning to the emission time interval 414, the SEL control line signal level 420 transitions from the asserted level 442 to an emission time interval low level 443, and the EMIT control signal level 422 transitions from its un-asserted level 446 to its emission time interval asserted level 447. Because the SEL control line signal level 420 is in its emission time interval low level 443, the SEL switch is open and the charge on the CPIX capacitor 320 does not change with the voltage on the V_data line 304. Therefore the data signal level on the V_data signal level 424 does not affect pixel operations, and the value of the V_data signal level 424 is shown to be set to an emission level 451.

Figure 5:
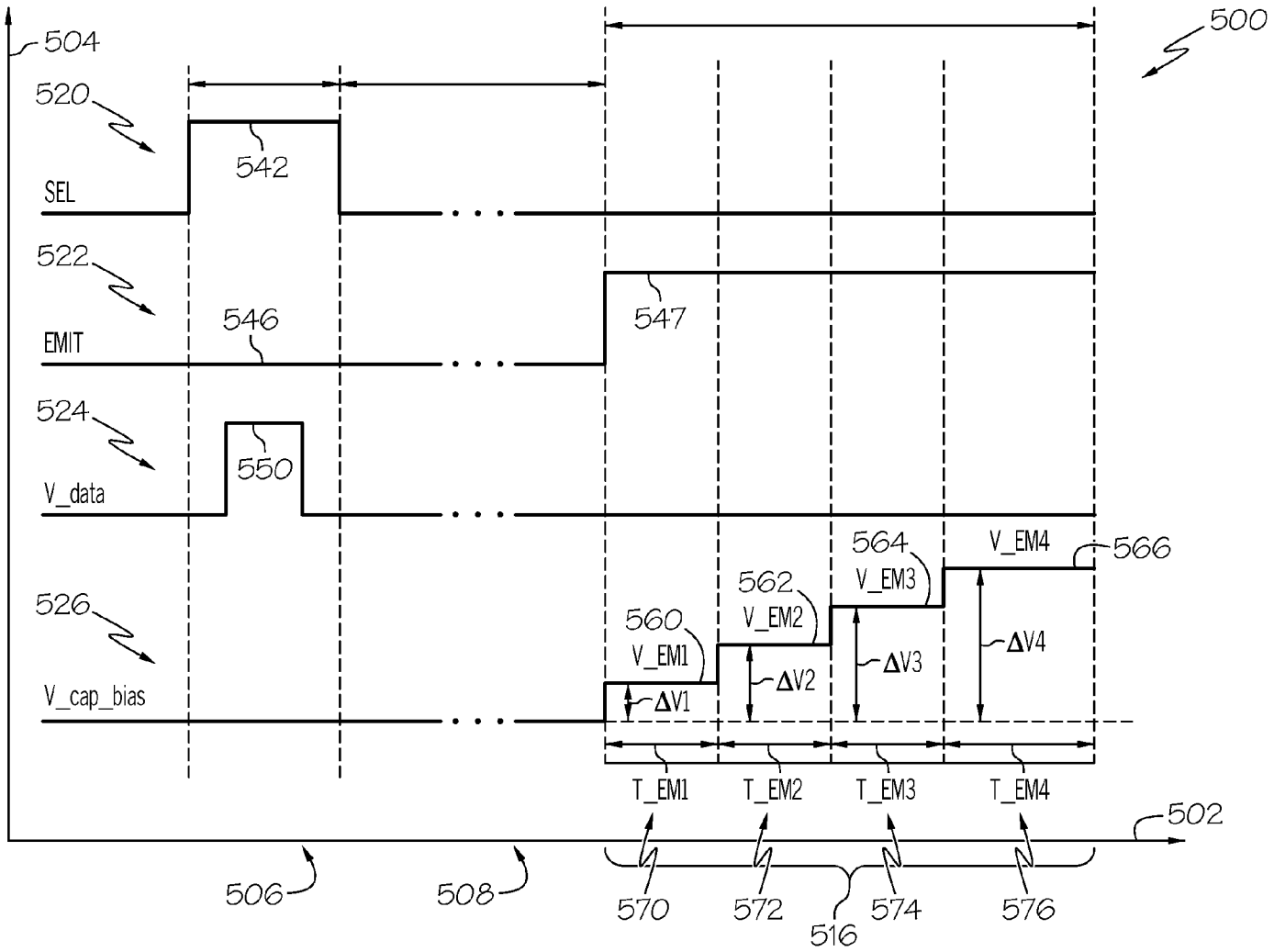
FIG. 5 illustrates a display brightness reduction signal diagram, according to one example.

FIG. 5 illustrates a display brightness reduction signal diagram 500, according to one example. The display brightness reduction signal diagram 500 depicts the levels of signals depicted in the programming time interval signal timing diagram 400, and further includes additional details of display brightness reduction processing associated with the V_cap_bias line 306 discussed above with regards to FIG. 3. The display brightness reduction signal diagram 500 includes a horizontal time axis 502 that depicts elapsed time for the illustrated waveforms. The display brightness reduction signal diagram 500 also has a vertical level axis 504. The level axis 504 indicates levels of the depicted signals of this example. The magnitude and polarity of the various depicted signals in various examples depends upon the design and characteristics of pixel hardware used in those examples. In various examples, similar signals in those examples convey similar information and have similar responses to those described below.

The display brightness reduction signal diagram 500 depicts a SEL1 control line signal level 520, an EMIT control line signal level 522, a V_data signal level 524 and a V_cap_bias level 526. With reference to FIG. 2, The SEL1 control line signal level 520 indicates the logic level present on the first row scan line 250, which causes the data on the data lines to each pixel in the first row of the pixel array 202 to be stored into the active elements of the pixels of the first row of the pixel array 202. In the illustrated example, the V_data signal level 524 represents the programmed voltage on one data line driving pixels in the display. With reference to FIG. 2, the V_data signal level 524 corresponds to the voltage present on one data line that is connected to all pixels in a particular row of the pixel array 202. The voltage depicted by the V_data signal level 524 is programmed into a voltage storage device, such as the CPIX capacitor 320, of a pixel in the row with an asserted select line, such as a line conveying the SEL1 control line signal level 520.

The display brightness reduction signal diagram 500 depicts several time intervals that are similar to the time intervals described above with regards to FIG. 4. A first row programming time interval 506 is shown during which the SEL1 control line signal level 520 is in a high stat 542, and the V_data signal level 524 is in a first pixel row data level 550. The EMIT control signal level 522 is in a low, or un-asserted, state during the first row programming time interval 506, indicating that pixels are not emitting light during this interval.

A sequence of other rows programming time intervals 508 is shown to follow the first row programming time interval 506. In the other rows programming time intervals 508, the V_data signal line 524 is set to voltage levels corresponding to the intensity of the corresponding pixel in a particular row and the SEL line (not shown) for that row is asserted to indicate that the pixel is to be programmed with that intensity level. During the other rows programming time intervals 508, the EMIT control signal is low, or un-asserted, indicating that the pixels are not to emit light during this time interval. The V_cap_bias signal level 526 is also at a low level during the other rows programming time intervals to cause the respective CPIX capacitors of the pixels in these rows to be programmed with, by being charged to, the programmed voltage present on the respective V_data lines during these time intervals. It is noted that the programming of pixels during the first program row programming time interval and the other rows programming time intervals 508 in one example is similar to the programing of active matrix pixels in conventional active matrix display structures with the exception of the presence of the V_cap_bias signal level 526.

In the display brightness reduction signal diagram 500, an emission time interval 516 follows the above described pixel programming time intervals. During the emission time interval 516, the SEL lines, which are similar to the row scan lines 250, 252, and 254 described above with regards to FIG. 2, are in a low states, or un-asserted. The voltages present on the V_data lines, such as the depicted V_data line level 524, therefore do not affect pixel operation since the SEL lines are low and the SEL switches 326 in the pixels are open. As illustrated in the display brightness reduction signal diagram 500, the emission time interval 516 follows a period during which all pixels are programmed with their programmed intensity values. As illustrated, the emission time interval 516 follows the first row programming time interval 506 and the other rows programming time intervals 508. This is in contrast to some conventional displays where the pixels of each row are programmed with their programmed intensity levels and then configured to emit light at their programmed intensity level while pixels of another row are programmed with their programmed intensity values.

The EMIT control signal level 522 is in a high, or asserted, state during the emission time interval 516. With reference to FIG. 3, the high level of the EMIT control signal level 522 causes the EMIT switch 328 to close, and completes the circuit from EL_VDD power line 308 to EL_VSS power line 310 through the drive transistor 322 and the OLED element 324. As discussed above, the electrical current flowing through the drive transistor 322, and therefore through the OLED element 324, is controlled by the voltage between the gate and source of the drive transistor 322. As discussed below, the voltage between the gate of the drive transistor 322, which is connected to the V_PIX line 340, and the source of the drive transistor 322, which is connected to EL_VSS 310 via the OLED element 324, is increased by stepping up the voltage on the V_cap_bias line 306 during time sub-intervals of the emission time interval 516.

The emission time interval 516 is shown to be divided into four time sub-intervals, a first emission time sub-interval 570, a second emission time sub-interval 572, a third emission time sub-interval 574, and a fourth emission time sub-interval 576. The display brightness reduction signal diagram 500 depicts the stepped increase of levels of the V_cap_bias signal level during the emission time interval 516. In this example, the V_cap_bias signal level is shown to be a first bias level 560 during the first emission time sub-interval 570, a second bias level 562 during the second emission time sub-interval 572, a third bias level 564 during the third emission time sub-interval 574, and a fourth bias level 566 during the fourth emission time sub-interval 576.

As illustrated in the display brightness reduction signal diagram 500, the voltage of the V_cap_bias signal level is increased by ΔV1 during the first emission time sub-interval 570, by ΔV2 during the second emission time sub-interval 572, by ΔV3 during the third emission time sub-interval 574, and by ΔV4 during the fourth emission time sub-interval 576. As shown in FIG. 3, an increase in the voltage level on the V_cap_bias line 306 causes an increase in the voltage present on the V_PIX line 340, which is the gate voltage of the drive transistor 322.

Figure 6:
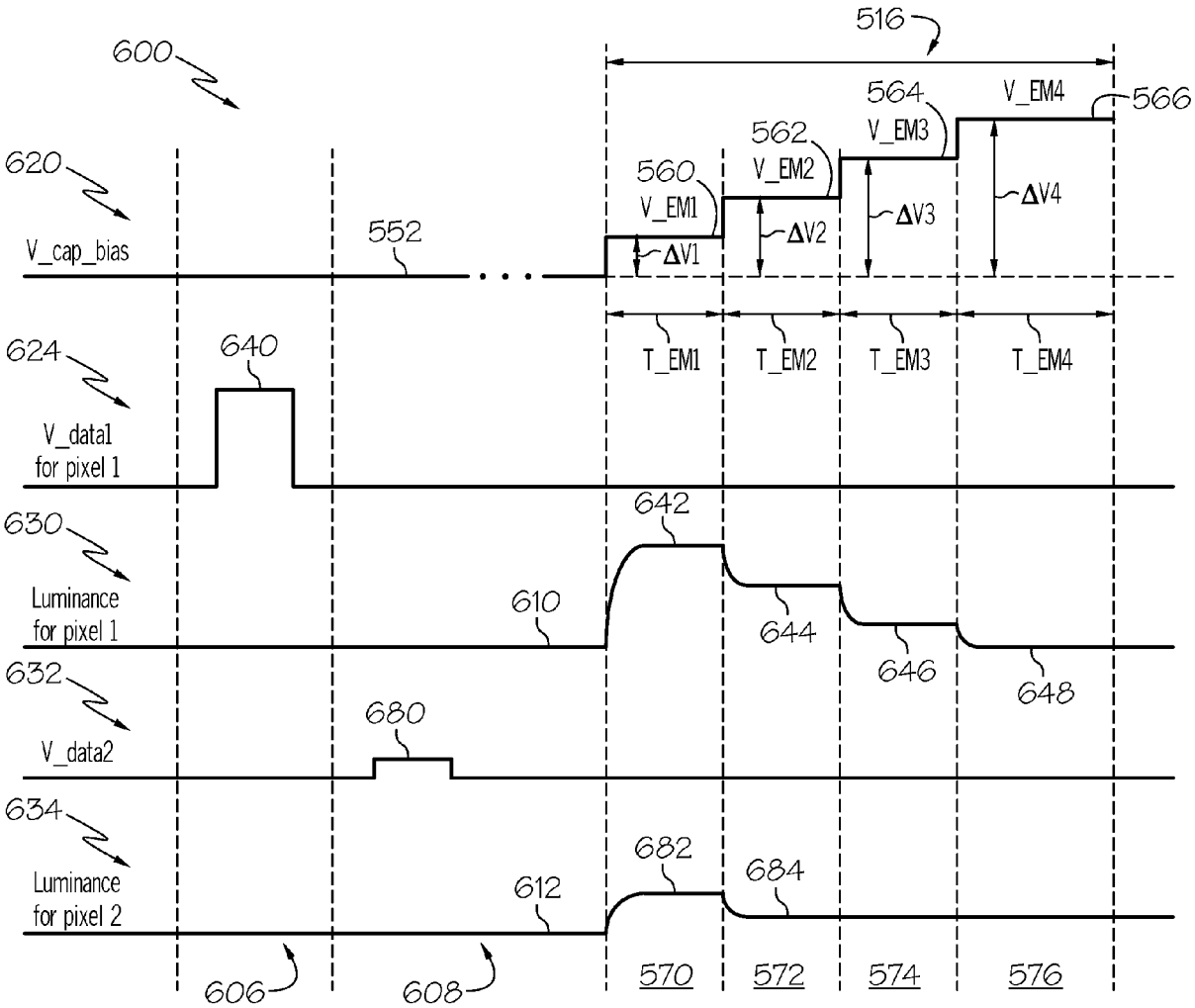
FIG. 6 illustrates a brightness reduction emission comparison diagram, according to one example.

FIG. 6 illustrates a brightness reduction emission comparison diagram 600, according to one example. The brightness reduction emission comparison diagram 600 depicts the brightness of light emitted by two pixels of an Active Matrix Organic Light Emitting Diode (AMOLED) display that incorporates an example display brightness reduction. The display brightness reduction implemented in this example is based upon a ramp of the voltage on the V_cap_bias line as is discussed above. The brightness reduction emission comparison diagram 600 depicts the values of signals present in the AMOLED display pixel circuit diagram 300, discussed above. The following discussion refers to two pixels, a first pixel and a second pixel. In one example, each of these two pixels has a design similar to that described with regards to the AMOLED display pixel circuit diagram 300 and the following description refers to elements described therein.

The brightness reduction emission comparison diagram 600 includes three primary time intervals, a first pixel programming interval 606, a second pixel programming interval 608, and an emission time interval 516. The emission time interval 516 is similar to the emission time interval 516 described above with regards to the display brightness reduction signal diagram of FIG. 5. The emission time interval 516 is shown to be divided into four time sub-intervals, a first emission time sub-interval 570, a second emission time sub-interval 572, a third emission time sub-interval 574, and a fourth emission time sub-interval 576.

The brightness reduction emission comparison diagram 600 includes a V_cap_bias signal level 620. As is described above with regards to display brightness reduction signal diagram 500, the V_cap_bias signal level 620 is at a low level during pixel programming, such as during the first pixel programing time interval 606 and the second pixel programming time interval 608. In the following discussion, this low level is referred to as a baseline level. In one example, the baseline level of the V_cap_bias level 620 is a ground voltage potential.

When operating to reduce the emitted brightness of the display, one example increases the voltage on the V_cap_bias line 306 during the emission time interval. In one example, the voltage of the V_cap_bias line 306 is increased in steps such that the voltage on the V_cap_bias line 306 is increased during each time sub-interval of the emission time interval 516. As represented by the V_cap_bias signal level 620, during the first emission time sub-interval 570, V_cap_bias is increased over a baseline voltage a ΔV1 to a first bias level 560, during a second emission time sub-interval 572 V_cap_bias is increased to a second bias level 562 that is ΔV2 above the baseline voltage, during a third emission time sub-interval 574 V_cap_bias is increased to a third bias level 564 that is ΔV3 above the baseline voltage, and during a fourth emission time sub-interval 576 V_cap_bias is increased to a second bias level 566 that is ΔV4 above the baseline voltage. In further examples, the brightness of the display is able to be reduced by increasing the voltage of the V_cap_bias line 306 in any suitable manner. It is to be noted that a display is able to be operated at full intensity by not increasing the voltage on the V_cap_bias line 306, thereby keeping the voltage of the V_cap_bias line 306 at the baseline voltage.

The brightness reduction emission comparison diagram 600 also depicts a V_data1 level 624 and a V_data2 level 632. The V_data1 level 624 and the V_data2 level 632 indicate the emission intensity, which corresponds to a brightness or luminance value for the pixel, that the pixel is to emit during the emission time interval. The V_data1 level 624 indicates a first pixel intensity value 640, which corresponds to the intensity value that is programmed into the first pixel during that pixel's programming time interval. The V_data2 signal level 632 indicates a second pixel intensity value 680, which is the intensity value that is programmed into the second pixel during that pixel's programming time interval.

With reference to FIG. 3, the first pixel intensity value 640 and the second pixel intensity value 680 correspond to voltages of the V_data line 304 during the time that the SEL switch 326 is closed for the first pixel and the second pixel, respectively. As discussed above, the drive transistor 322 in the illustrated example is a P-Channel FET transistor. As such, higher intensity levels are programmed into the pixel by placing a lower voltage on the V_PIX line. An intensity, or brightness, level of a pixel is programmed into the pixel by the operation of the SEL switch 326, which causes an intensity programming voltage to be charged onto the CPIX capacitor 320 of a pixel being programmed. After that CPIX capacitor is charged, the SEL switch 326 opens and, due to the high impedance of the gate of the drive transistor 322, the CPIX capacitor 320 retains the voltage to which it was charged. The SEL switch 326 in one example is operated based upon logic levels of row scan lines for the display, as is described above.

The first pixel intensity value 640 and the second pixel intensity value 680 are shown to occur at different time intervals in order to more clearly describe certain aspects of this example. It is clear that these two data voltages are able to be programmed into these respective pixels in the same row by using with different data lines. It is also clear that these two pixels are able to be in the same column of the display, and therefore programmed by data voltages carried on the same data line, but at different times that are indicated by the logic levels of associated row scan lines.

The example illustrated by the brightness reduction emission comparison diagram 600 depicts the first pixel intensity value 640 to be higher than the second pixel intensity value 680. Due to the structure of the active circuits in this example pixel, the higher intensity level of the first pixel intensity value 640 result in a lower voltage being charged onto the CPIX capacitor 326 of the first pixel than is charged onto the CPIX capacitor 326 of the second pixel. Stating the converse, the CPIX capacitor 326 of the second pixel is charged with a higher voltage than the CPIX capacitor 326 of the first pixel in this example.

The brightness reduction emission comparison diagram 600 depicts two luminance level traces, a first luminance level trace 630 and a second luminance level trace 634. The first luminance level trace 630 indicates the luminance, or light emission intensity, of the first pixel, and the second luminance level trace 634 indicates the luminance, or light emission intensity, of the second pixel. The luminance of an OLED element is known to be proportionate to the amount of electrical current passing through the OLED element. The luminance level traces therefore are representative of the electrical current flowing through their respective OLED elements. With reference to FIG. 3, the electrical current that flows through the OLED element 324 of a pixel with the design portrayed in FIG. 3 is controlled by the voltage difference between the gate and source of the drive transistor 322, which is the voltage difference between the V_PIX line 340 and EL_VSS 310 less the voltage drop across the OLED element 324.

It is noted that the first luminance level trace 630 and the second luminance level trace 634 have a low, or zero, level 610, 612 during the programming time intervals, such as the first pixel programming time interval 606 and the second pixel programming time interval 608. This is due to the operation of the EMIT switch 328, which is open in this example, and not conducting, during the programming time intervals.

During the emission time interval 516, the first luminance trace level 630 depicts the luminance level emitted by, which is proportional to the electrical current flowing through, the first pixel. The first pixel is programmed to emit an intensity level that is set by the first pixel intensity value 640 by programming a first intensity voltage onto the CPIX capacitor 326 of the first pixel. The luminance, or emitted light intensity, of the first pixel is based upon the voltage difference between the V_PIX line 340 of the first pixel and the voltage of the source of the drive transistor 322—EL_VSS 310 less the voltage across the OLED element 324, which controls the electrical current passing through the drive transistor 322 of that pixel. The voltage of the V_PIX line 340 of a particular pixel is the respective sum of the voltage across the CPIX capacitor 320 and the voltage of the V_cap_bias line 306 for that pixel. The ramping up of the voltage of the V_cap_bias line 340 during the emission time interval 516 causes the voltage of the V_PIX line 340 to correspondingly increase, and thereby decreases the electrical current flowing through the P-Channel FET drive transistor 322 and the OLED element 324. In the following discussion, the voltage on the V_PIX line 340 is referred to as $V_{gate}$ because this is the voltage on the gate of the drive transistor 322. It is clear that $V_{gate}$ is the sum of the voltage charged across the CPIX capacitor 320 and the voltage on the V_cap_bias line 306, which is illustrated as an increasing step function during the emission time interval 516.

During the illustrated first emission time sub-interval 570, the first luminance trace level indicates the first pixel emits light with a first pixel first luminance level 642. The first pixel first luminance level 642 is based upon the difference between $V_{gate}$ and the voltage of the gate of the drive transistor 322, which is EL_VSS 310 less the voltage across the OLED element 324. During the first emission time sub-interval 570, $V_{gate}$, which is the sum of V_cap_bias and the voltage on the CPIX capacitor, is increased by a value of V_EM1, which is the increase in the voltage of V_cap_bias over the baseline voltage. The increase of $V_{gate}$ reduces the electrical current flowing through the OLED element 324 of the first pixel and correspondingly reduces the emitted intensity of the pixel during the first emission time sub-interval by a corresponding amount.

During the second emission time sub-interval 572, the first luminance trace level indicates the first pixel emits light with a first pixel second luminance level 644. During the second emission time sub-interval 572, $V_{gate}$ is increased by a value of V_EM2 above the baseline V_cap_bias voltage. In this example, V_EM2 is larger than the voltage increase of the previous sub-interval, i.e., V_EM1, and therefore Vgate is further increased during the second emission time sub-interval 572 relative to the first emission time sub-interval 570.

Due to the further increase in $V_{gate}$, the electrical current flowing through the OLED element 324 of the first pixel, and the corresponding emitted intensity of the pixel during the second emission time sub-interval 572, are further reduced during the second emission time sub-interval 572 relative to the first emission time sub-interval 570.

During the third emission time sub-interval 574, the first luminance trace level indicates the first pixel emits light with a third pixel first luminance level 646. The first pixel third luminance level 646 is lower than the first pixel second luminance level 644 because $V_{gate}$ is increased by a value of V_EM3 above the baseline value, which is greater than the value of V_EM2. This greater increase in $V_{gate}$ causes an even greater reduction in electrical current flowing through the OLED element 324 of the first pixel and a correspondingly greater reduction of the emitted intensity of the pixel during the third emission time sub-interval by a corresponding amount.

During the fourth emission time sub-interval 576, the first luminance trace level indicates the first pixel emits light with a first pixel fourth luminance level 648. The first pixel fourth luminance level 648 is lower than the first pixel third luminance level 646 because $V_{gate}$ is increased by a value of V_EM4 above the baseline value, which is greater than the value of V_EM3. In the illustrated example, the value of V_EM4 is sufficiently large that the first pixel fourth luminance level 648 is reduced to a level near zero. In other words, in this illustrated example, the OLED element 324 is not emitting light during the fourth emission time sub-interval 576.

With regards to the second pixel, the second luminance trace level 634 indicates that the second pixel emits light with a second pixel first luminance level 682 during the first emission time sub-interval 570. The second pixel first luminance level 682 is based upon the difference between $V_{gate}$ and the source of the drive transistor 322, which is EL_VSS 310 less the voltage across the OLED element 324. Because the second pixel intensity value 680 is lower than the first pixel intensity value 640, the CPIX capacitor 320 of the second pixel in this example is charged to a higher voltage than the CPIX capacitor 320 of the first pixel. This results in a higher value of $V_{gate}$, for this second pixel during the first emission time sub-interval 570. As described above with regards to the first pixel, the value of $V_{gate}$ is increased in this example during the first emission time sub-interval 570 by a value of V_EM1, which is the increase in the voltage of V_cap_bias over the baseline voltage. The increase of $V_{gate}$ reduces the electrical current flowing through the OLED element 324 of the first pixel and correspondingly reduces the emitted intensity of the pixel during the first emission time sub-interval by a corresponding amount.

Figure 7:
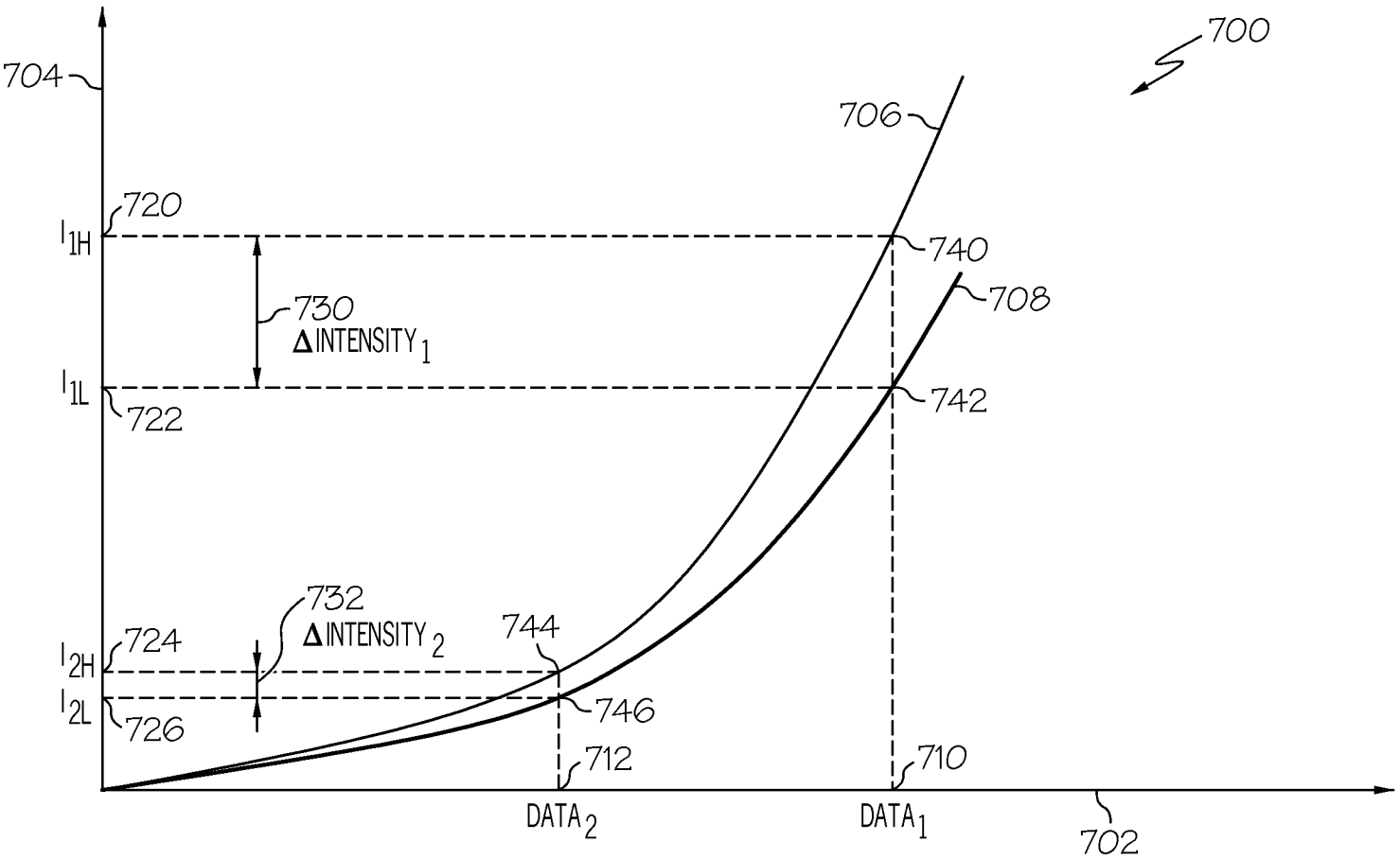
FIG. 7 illustrates a pixel intensity command vs. emitted intensity chart, according to one example.

During the second emission time sub-interval 572, the second luminance trace level 634 indicates that the second pixel emits light with a second pixel second luminance level 684. During the second emission time sub-interval 572, $V_{gate}$ is increased by a value of V_EM2 above the baseline V_cap_bias voltage. In this example, V_EM2 is larger than the voltage increase of the previous sub-interval, i.e., V_EM1, and therefore $V_{gate}$ is further increased during the second emission time sub-interval 572 relative to the first emission time sub-interval 570. Due to the further increase in $V_{gate}$, the electrical current flowing through the OLED element 324 of the second pixel, and the corresponding emitted intensity of the pixel during the second emission time sub-interval 572, are further reduced during the second emission time sub-interval 572 relative to the first emission time sub-interval 570. Due to the lower programmed intensity level for the second pixel, it is noted that the second pixel second luminance level 684 is near the zero level in this example. The increase in the voltage on the V_cap_bias line 306 to V_EM2 caused $V_{gate}$, to increase to a level that essentially halted FIG. 7 illustrates a pixel intensity command vs. emitted intensity chart 700, according to one example. The pixel intensity command vs. emitted intensity chart 700 includes an intensity command, or grayscale value, axis 702 and an emitted intensity axis 704. The intensity command axis 702 represents the intensity, or brightness, value that is programmed into the pixel. The brightness of the pixel is also referred to as a grayscale value for that pixel. Referring to FIG. 3, the intensity command provided to a pixel is represented by the voltage on the V_data line 304, and operates to control the electrical current that flows though the OLED element 324 of that pixel during the emission time interval. The emitted intensity axis 704 indicates the intensity of light emitted by the OLED element of the pixel. The intensity of light emitted by an OLED element is proportional to the electrical current flowing through the OLED element.

The pixel intensity command vs. emitted intensity chart 700 depicts two gamma curves, a full brightness gamma curve 706 and a reduced brightness gamma curve 708. The full brightness gamma curve 706 and the reduced brightness gamma curve 708 indicate relationships between intensity commands provided to a pixel, as indicated by values along the intensity command axis 702, and the emitted light intensity produced by the OLED element of the pixel.

The full brightness gamma curve 706 indicates this relationship for a pixel that is not performing the above described brightness reduction processing. Referring to the example presented in FIG. 3, the full brightness gamma curve 706 reflects the pixel intensity command to emitted intensity when the V_cap_bias line 306 is held at a baseline voltage, which is usually a low or zero voltage, during the emission time interval.

The reduced brightness gamma curve 708 indicates this relationship for a pixel that is performing the above described brightness reduction processing. Referring to the example presented in FIGS. 3 and 6, the reduced brightness gamma curve 708 reflects the pixel intensity command to emitted intensity when the V_cap_bias line 306 has a voltage that is above the baseline voltage during the emission time interval.

The two gamma curves depicted in the pixel intensity command vs. emitted intensity chart 700 illustrate the difference in emitted light intensity between a pixel that is not performing brightness reduction and a pixel that is performing brightness reduction. This difference is shown for two intensity command values, a data1 value 710 and a data2 value 712. In this example, the data1 value 710 is a higher value, i.e., it indicates a brighter intensity for the pixel, than the data2 value 712. Due to the non-linear response of these gamma curves, the command for brighter intensity, the data1 value 710 in this example, results in a greater decrease in emitted light brightness between the pixel that is not performing brightness reduction and the pixel that is performing brightness reduction, than the reduction in brightness for the data2 value 712.

The data1 value 710 is shown to intersect the full brightness gamma curve 706 at a first high brightness point 740. The first high brightness point 740 indicates an emitted intensity value of $I_{1H}$ 720. The data1 value 710 is shown to intersect the reduced brightness gamma curve 708 at a first low brightness point 742. The first low brightness point 742 indicates an emitted intensity value of $I_{1L}$ 722. The difference between $I_{1H}$ 720 and $I_{1L}$ 722 is shown to be $\Delta$intensity$_1$ 730.

The data2 value 712 is shown to intersect the full brightness gamma curve 706 at a second high brightness point 744. The second high brightness point 744 indicates an emitted intensity value of $I_{2H}$ 724. The data2 value 712 is shown to intersect the reduced brightness gamma curve 708 at a second low brightness point 746. The second low brightness point 746 indicates an emitted intensity value of $I_{2L}$ 726. The difference between $I_{2H}$ 724 and $I_{2L}$ 726 is shown to be $\Delta$intensity$_2$ 732.

The full brightness gamma curve 706 and the reduced brightness gamma curve 708 are noted to have a similar shape with a monotonically increasing slope with increasing values of intensity commands. This increasing slope of the gamma curves results in the value of $\Delta$intensity$_1$ 730 being greater than $\Delta$intensity$_2$ 732. Due to this relationship, pixels that are programmed to emit brighter intensities have a greater reduction of emitted light intensity when performing the above described brightness reduction processing. This reduction of emitted light intensity in proportion to the brightness command for the pixel implements an automatic gamma reduction in the display. The above described example further implements this selective and display wide gamma reduction by adding a single signal path, the V_cap_bias line 306, to the display and without adding components to each pixel of the display. Further, the above described examples provide a computationally efficient technique to provide a proportional brightness reduction based on programmed pixel intensity in that the above described example does not perform pixel-by-pixel image processing to apply a proportional brightness reduction to each brightness command in the data defining each image to be displayed.

Figure 8:
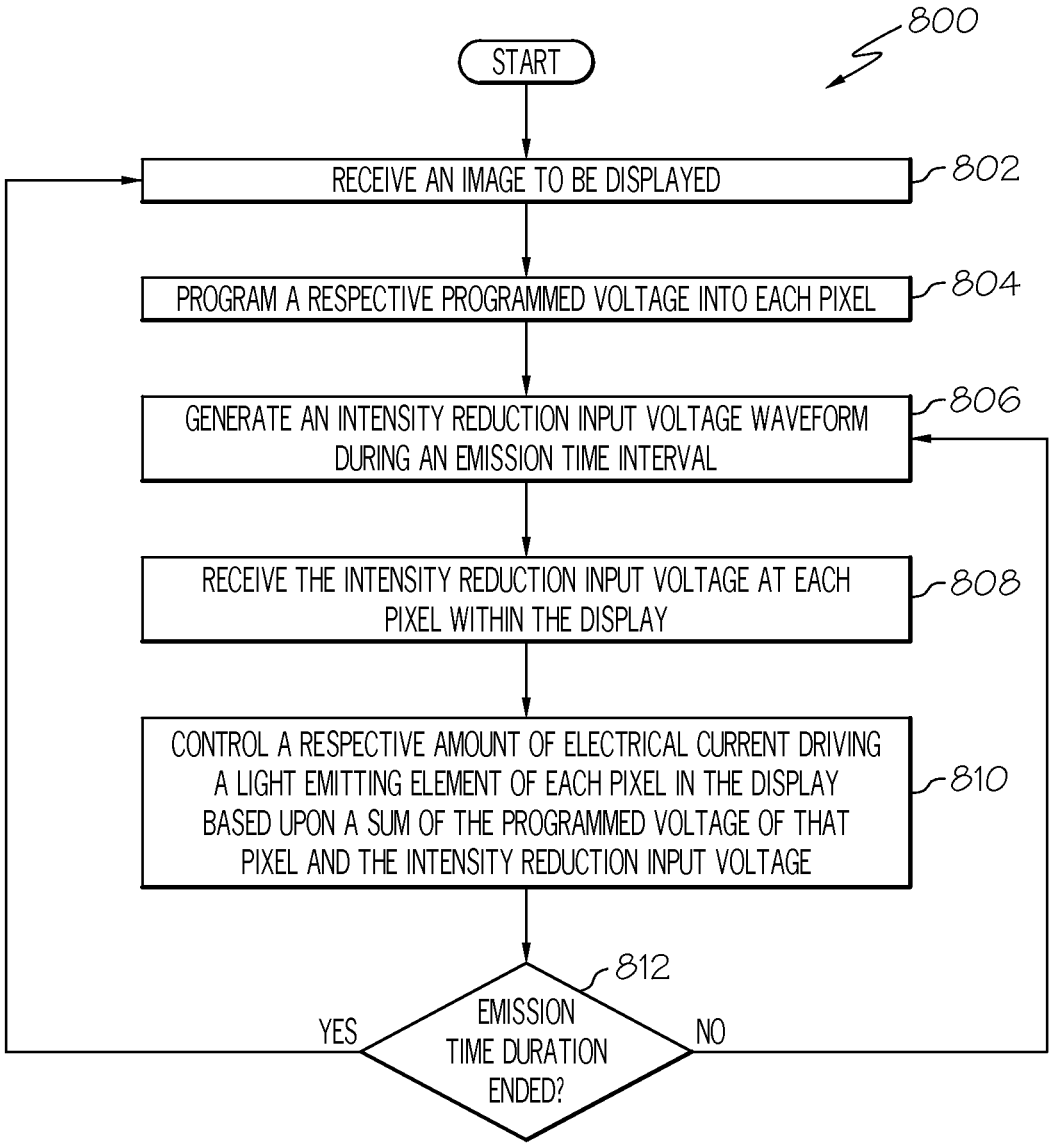
FIG. 8 illustrates a display brightness reduction processing flow, according to one example.

FIG. 8 illustrates a display brightness reduction processing flow 800, according to one example. The display brightness reduction processing flow 800 is performed in one example by circuits that drive the pixels of a display, such as are described above with regards to the AMOLED display component diagram 200 with regards to FIG. 2, operating in conjunction with pixels similar to the AMOLED display pixel circuit diagram 300 described with regards to FIG. 3. The following description refers to elements of FIGS. 2 and 3.

The display brightness reduction processing flow 800 begins by receiving, at 802, an image to display. In one example, an image to be displayed is generated by a processor creating, for example, a user interface display. In further examples, images are retrieved from a storage to be displayed as an image or as part of a motion picture. Further examples of images are also able to be received. In one example, the image to be displayed is received by an image source 204 and is provided to the scan generator 230 and the data generator 232.

The display brightness reduction processing flow 800 continues by programming, at 804, a respective programmed voltage into each pixel. In one example, the respective program voltage represents a brightness to be emitted by the respective pixel being programmed. This brightness value is determined, in one example, based upon the image data received in the above step. In the example described above, this programming is performed by charging the CPIX capacitor 320 with the programmed voltage that is delivered on the V_data line 304. As described above, the programming of voltages indicating emitted light intensity for a pixel is performed on each pixel of the pixel array 202 by the operation of the scan generator 230 and the data generator 232.

The display brightness reduction processing flow 800 continues by generating, at 806, an intensity reduction input voltage during the emission time duration of the display. In one example, the intensity reduction input voltage has a time varying waveform, such as the stepped ramp function described above. In one example, a controller is able to not perform emitted intensity reduction processing by generating an intensity reduction input voltage that is at a baseline level, such as at a ground voltage, for the duration of the emission time duration.

The display brightness reduction processing flow 800 continues by receiving, at 808, the intensity reduction input voltage at each pixel within the display. In one example, the intensity reduction input voltage is received along a conductive coupling that is coupled to each pixel within the display.

The display brightness reduction processing flow 800 continues by controlling, at 810, electrical current driving a light emitting element of each pixel in the display based upon a sum of the respective programmed voltage programmed into the respective pixel and the intensity reduction voltage. In one example, the electrical current is controlled in each pixel by coupling a gate of a thin film transistor fabricated adjacent to the light emitting element to a series combination of a voltage storage device charged with the programmed voltage and the intensity reduction input voltage.

The display brightness reduction processing flow 800 proceeds by determining, at 812, if the emission time duration has ended. If the emission time duration has not ended, the display brightness reduction processing flow 800 returns to generating, at 806, the intensity reduction input voltage, as described above. If the emission time duration has ended, the display brightness reduction processing flow 800 returns to receiving, at 802, an image, as is described above.

Figure 9:
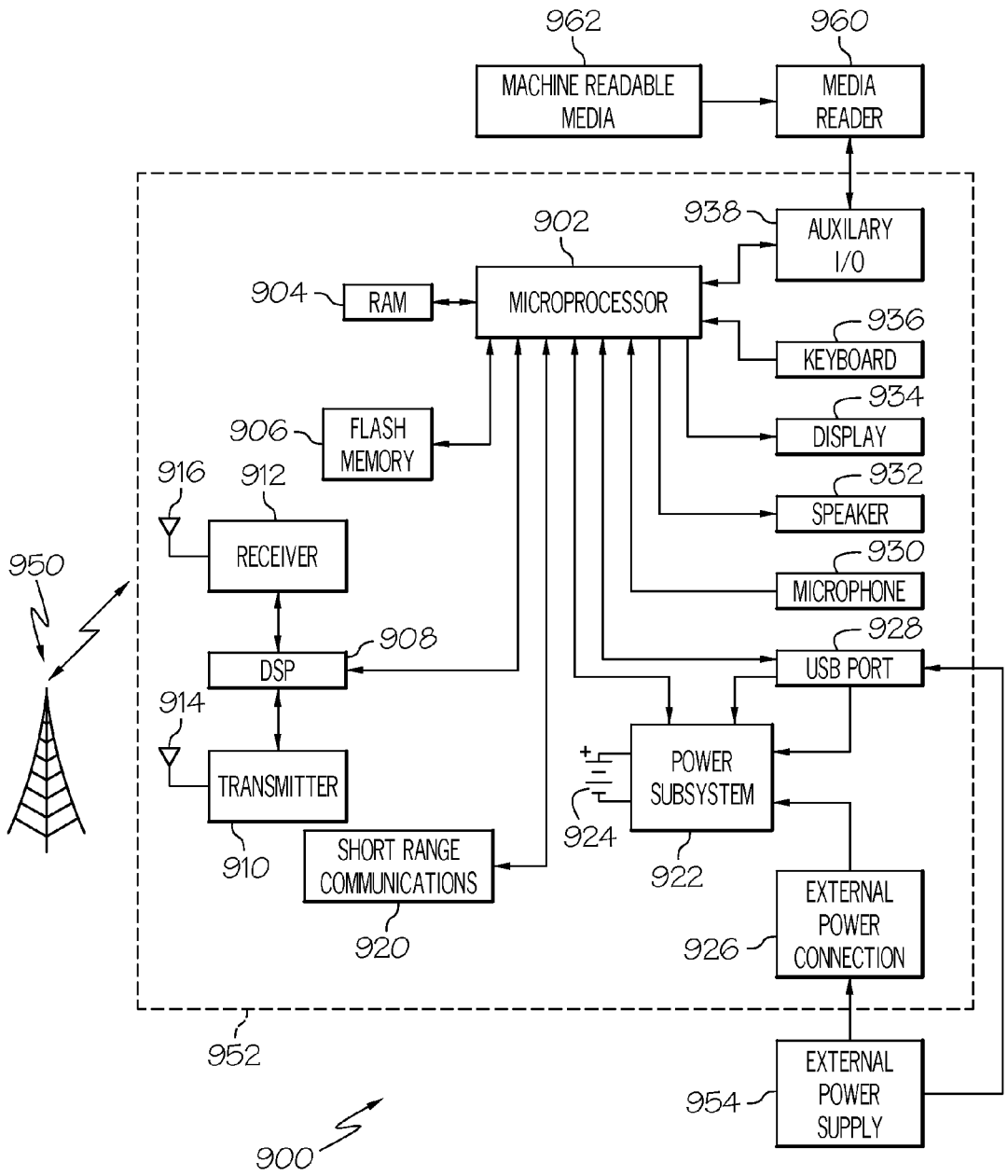
FIG. 9 is a block diagram of an electronic device and associated components in which the systems and methods disclosed herein may be implemented.

FIG. 9 is a block diagram of an electronic device and associated components 900 in which the systems and methods disclosed herein may be implemented. In this example, an electronic device 952 is a wireless two-way communication device with voice and data communication capabilities. Such electronic devices communicate with a wireless voice or data network 950 using a suitable wireless communications protocol. Wireless voice communications are performed using either an analog or digital wireless communication channel. Data communications allow the electronic device 952 to communicate with other computer systems via the Internet. Examples of electronic devices that are able to incorporate the above described systems and methods include, for example, a data messaging device, a two-way pager, a cellular telephone with data messaging capabilities, a wireless Internet appliance or a data communication device that may or may not include telephony capabilities. A particular example of such an electronic device is the handheld communications device 100, discussed above.

The illustrated electronic device 952 is an example electronic device that includes two-way wireless communications functions. Such electronic devices incorporate communication subsystem elements such as a wireless transmitter 910, a wireless receiver 912, and associated components such as one or more antenna elements 914 and 916. A digital signal processor (DSP) 908 performs processing to extract data from received wireless signals and to generate signals to be transmitted. The particular design of the communication subsystem is dependent upon the communication network and associated wireless communications protocols with which the device is intended to operate.

The electronic device 952 includes a microprocessor 902 that controls the overall operation of the electronic device 952. The microprocessor 902 interacts with the above described communications subsystem elements and also interacts with other device subsystems such as flash memory 906, random access memory (RAM) 904. The flash memory 906 and RAM 904 in one example contain program memory and data memory, respectively. The microprocessor 902 also interacts with an auxiliary input/output (I/O) device 938, a USB Port 928, a display 934, a keyboard 936, a speaker 932, a microphone 930, a short-range communications subsystem 920, a power subsystem 922, and any other device subsystems.

The electronic device 952 is an example of an electronic display device, which includes a display 934. The display 934 in various examples is an AMOLED based display such as is described above with regards to FIG. 2. In various examples, the microprocessor 902 determines an amount of brightness reduction to be applied to the display 934 and provides a brightness reduction level input to the display 934, or associated circuitry of other examples, in order to implement the above described reduction of pixel emitted intensity. In various examples, the amount of brightness reduction is determined by a user input, a detection of a level of ambient light, other criteria, or combinations of these factors. The microprocessor 902 in one example is further able to provide data to the display 934 that defines images or other presentations to display to, for example, a user of the electronic device 952.

A battery 924 is connected to a power subsystem 922 to provide power to the circuits of the electronic device 952. The power subsystem 922 includes power distribution circuitry for providing power to the electronic device 952 and also contains battery charging circuitry to manage recharging the battery 924. The power subsystem 922 includes a battery monitoring circuit that is operable to provide a status of one or more battery status indicators, such as remaining capacity, temperature, voltage, electrical current consumption, and the like, to various components of the electronic device 952.

The USB port 928 further provides data communication between the electronic device 952 and one or more external devices. Data communication through USB port 928 enables a user to set preferences through the external device or through a software application and extends the capabilities of the device by enabling information or software exchange through direct connections between the electronic device 952 and external data sources rather then via a wireless data communication network.

Program information, which is able to include machine readable program code that defines various operating programs including operating system software, application programs, and the like, that is used by the microprocessor 902 is stored in flash memory 906. Further examples are able to use a battery backed-up RAM or other non-volatile storage data elements to store program information such as operating systems, other executable programs, or both. The operating system software, device application software, or parts thereof, are able to be temporarily loaded into volatile data storage such as RAM 904. Data received via wireless communication signals or through wired communications are also able to be stored to RAM 904.

The microprocessor 902, in addition to its operating system functions, is able to execute software applications on the electronic device 952. A predetermined set of applications that control basic device operations, including at least data and voice communication applications, is able to be installed on the electronic device 952 during manufacture. Examples of applications that are able to be loaded onto the device may be a personal information manager (PIM) application having the ability to organize and manage data items relating to the device user, such as, but not limited to, e-mail, calendar events, voice mails, appointments, and task items. Further applications include applications that have input cells that receive data from a user.

Further applications may also be loaded onto the electronic device 952 through, for example, the wireless network 950, an auxiliary I/O device 938, USB port 928, short-range communications subsystem 920, or any combination of these interfaces. Such applications are then able to be installed by a user in the RAM 904 or a non-volatile store for execution by the microprocessor 902.

In a data communication mode, a received signal such as a text message or web page download is processed by the communication subsystem, including wireless receiver 912 and wireless transmitter 910, and communicated data is provided the microprocessor 902, which is able to further process the received data for output to the display 934, or alternatively, to an auxiliary I/O device 938 or the USB port 928. A user of the electronic device 952 may also compose data items, such as e-mail messages, using the keyboard 936, which is able to include a complete alphanumeric keyboard or a telephone-type keypad, in conjunction with the display 934 and possibly an auxiliary I/O device 938. Such composed items are then able to be transmitted over a communication network through the communication subsystem.

For voice communications, overall operation of the electronic device 952 is substantially similar, except that received signals are generally provided to a speaker 932 and signals for transmission are generally produced by a microphone 930. Alternative voice or audio I/O subsystems, such as a voice message recording subsystem, may also be implemented on the electronic device 952. Although voice or audio signal output is generally accomplished primarily through the speaker 932, the display 934 may also be used to provide an indication of the identity of a calling party, the duration of a voice call, or other voice call related information, for example.

Depending on conditions or statuses of the electronic device 952, one or more particular functions associated with a subsystem circuit may be disabled, or an entire subsystem circuit may be disabled. For example, if the battery temperature is low, then voice functions may be disabled, but data communications, such as e-mail, may still be enabled over the communication subsystem.

A short-range communications subsystem 920 is a further optional component which may provide for communication between the electronic device 952 and different systems or devices, which need not necessarily be similar devices. For example, the short-range communications subsystem 920 may include an infrared device and associated circuits and components or a Radio Frequency based communication module such as one supporting Bluetooth® communications, to provide for communication with similarly-enabled systems and devices.

A media reader 960 is able to be connected to an auxiliary I/O device 938 to allow, for example, loading computer readable program code of a computer program product into the electronic device 952 for storage into flash memory 906. One example of a media reader 960 is an optical drive such as a CD/DVD drive, which may be used to store data to and read data from a computer readable medium or storage product such as computer readable storage media 962. Examples of suitable computer readable storage media include optical storage media such as a CD or DVD, magnetic media, or any other suitable data storage device. Media reader 960 is alternatively able to be connected to the electronic device through the USB port 928 or computer readable program code is alternatively able to be provided to the electronic device 952 through the wireless network 950.

Information Processing System

The present subject matter can be realized in hardware, software, or a combination of hardware and software. A system can be realized in a centralized fashion in one computer system, or in a distributed fashion where different elements are spread across several interconnected computer systems.

Any kind of computer system—or other apparatus adapted for carrying out the methods described herein—is suitable. A typical combination of hardware and software could be a general purpose computer system with a computer program that, when being loaded and executed, controls the computer system such that it carries out the methods described herein.

The present subject matter can also be embedded in a computer program product, which comprises all the features enabling the implementation of the methods described herein, and which—when loaded in a computer system—is able to carry out these methods. Computer program in the present context means any expression, in any language, code or notation, of a set of instructions intended to cause a system having an information processing capability to perform a particular function either directly or after either or both of the following a) conversion to another language, code or, notation; and b) reproduction in a different material form.

Each computer system may include, inter alia, one or more computers and at least a computer readable medium allowing a computer to read data, instructions, messages or message packets, and other computer readable information from the computer readable medium. The computer readable medium may include computer readable storage medium embodying non-volatile memory, such as read-only memory (ROM), flash memory, disk drive memory, CD-ROM, and other permanent storage. Additionally, a computer medium may include volatile storage such as RAM, buffers, cache memory, and network circuits. Furthermore, the computer readable medium may comprise computer readable information in a transitory state medium such as a network link and/or a network interface, including a wired network or a wireless network, that allow a computer to read such computer readable information.

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the disclosed subject matter in virtually any appropriately detailed structure and function. Further, the terms and phrases used herein are not intended to be limiting, but rather, to provide an understandable description.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language). The term "coupled," as used herein, is defined as "connected," although not necessarily directly, and not necessarily mechanically. The term "configured to" describes hardware, software or a combination of hardware and software that is adapted to, set up, arranged, built, composed, constructed, designed or that has any combination of these characteristics to carry out a given function. The term "adapted to" describes hardware, software or a combination of hardware and software that is capable of, able to accommodate, to make, or that is suitable to carry out a given function.

Although specific embodiments of the subject matter have been disclosed, those having ordinary skill in the art will understand that changes can be made to the specific embodiments without departing from the spirit and scope of the disclosed subject matter. The scope of the disclosure is not to be restricted, therefore, to the specific embodiments, and it is intended that the appended claims cover any and all such applications, modifications, and embodiments within the scope of the present disclosure.

What is claimed is:

1. A method of controlling a multiple pixel display, the method comprising:

programming, into each respective pixel of a plurality of pixels within a multiple pixel display, a respective programmed voltage, the respective programmed voltage representing a respective brightness to be emitted by the respective pixel;

receiving at each pixel within the plurality of pixels, along a conductive coupling coupled to each pixel within the plurality of pixels, an intensity reduction input voltage; and reducing, by a reduction amount based upon the intensity reduction input voltage, a respective intensity of light emitted by each pixel in the plurality of pixels during an emission time interval for the multiple pixel display.

2. The method of claim 1, further comprising producing, during the emission time interval for the multiple pixel display, the intensity reduction voltage based on an amount of intensity reduction to be applied to each pixel within the plurality of pixels.

3. The method of claim 2, the intensity reduction voltage having a voltage defined as a stepped ramp function during the emission time interval.

4. The method of claim of claim 2, further comprising accepting a brightness reduction level input, and wherein the intensity reduction voltage is based upon the brightness reduction level input.

5. The method of claim 1, wherein the light emitting element comprising an organic light emitting diode.

6. The method of claim 1, wherein the controlling comprises coupling, in each pixel of the plurality of pixels, a respective gate of a respective thin film transistor fabricated adjacent to the light emitting element to a respective series combination of the conductive coupling and a respective voltage storage device charged with the programmed voltage.

7. The method of claim 1, wherein the respective programmed voltage represents the respective brightness to be emitted by the respective pixel during an emission time interval, wherein the intensity reduction input voltage has a respective average voltage magnitude value during the emission time interval that is able to be different during different emission time intervals, and wherein the reduction amount is based on the respective average voltage magnitude and is different for different average voltage magnitude values.

8. A multiple pixel display, comprising:

a plurality of pixels, each pixel in the plurality of pixels comprising:

a light emitting element;

a drive current controller comprising a control terminal, the control terminal receiving an intensity control input, the drive current controller configured to drive the light emitting element with an amount of electrical current based upon the intensity control input;

a voltage storage device comprising a first terminal and a second terminal electrically opposite the first terminal, the voltage storage device configured to be charged with a programmed voltage between the first terminal and the second terminal, the programming voltage representing a respective brightness to be emitted by the light emitting element, the first terminal being electrically coupled to the control terminal; and an intensity reduction input, electrically coupled to the second terminal, the intensity reduction input of each pixel being electrically coupled to respective intensity reduction inputs of other pixels within the plurality of pixels;

a bias generator configured to produce a bias voltage based on an amount of intensity reduction to be applied to each pixel within the plurality of pixels, the bias generator further configured to apply the bias voltage to the respective intensity reduction input of each of the plurality of pixels during an emission time interval to reduce an intensity of light emitted by the each pixel of the plurality of pixels during an emission time interval; and a conductive coupling, conductively coupling the bias voltage to each intensity reduction input of each pixel in the plurality of pixels.

9. The multiple pixel display of claim 8, the bias generator configured to generate a bias voltage having a voltage defined as a stepped ramp function during the emission time interval.

10. The multiple pixel display of claim 8, the bias generator configured to receives a brightness reduction level input, the bias generator adjusting the bias voltage based upon the brightness reduction level input.

11. The multiple pixel display of claim 8, the light emitting element comprising an organic light emitting diode.

12. The multiple pixel display of claim 8, the drive current controller comprising a thin film transistor fabricated adjacent to the light emitting element.

13. The multiple pixel display of claim 8, drive current controller comprising a P-channel field effect transistor, wherein the intensity control input comprises a programming voltage that is stored onto the voltage storage device, wherein the P-channel field effect transistor varies the amount of electrical current in reverse proportion to the intensity control input, and wherein the intensity reduction input receives an intensity reduction control voltage, wherein the amount of electrical current is reduced in proportion to the intensity reduction control voltage.

14. A non-transitory machine readable storage medium having machine readable program code embodied therewith, the machine readable program code comprising instructions for: programming, into each pixel of a plurality of pixels within a multiple pixel display, a respective programmed voltage, the respective programmed voltage representing a respective brightness to be emitted by the respective pixel; receiving at each pixel within the plurality of pixels, along a conductive coupling coupled to each pixel within the plurality of pixels, an intensity reduction input voltage; and reducing, by a reduction amount based upon the intensity reduction input voltage, a respective intensity of light emitted by each pixel in the plurality of pixels during an emission time interval for the multiple pixel display.

15. The machine readable storage medium of claim 14, the machine readable program code further comprising instructions for producing, during the emission time interval for the multiple pixel display, the intensity reduction voltage based on an amount of intensity reduction to be applied to each pixel within the plurality of pixels.

16. The machine readable storage medium of claim 15, the intensity reduction voltage having a voltage defined as a stepped ramp function during the emission time interval.

17. The machine readable storage medium of claim 15, the machine readable program code further comprising instructions for accepting a brightness reduction level input, and wherein the intensity reduction voltage is based upon the brightness reduction level input.

18. An electronic display device comprising:

a processor;

a memory, coupled to the processor, configured to store at least one of program information and data; and a multiple pixel display, coupled to the processor, the multiple pixel display comprising a plurality of pixels, each pixel in the plurality of pixels comprising:

a light emitting element;

a drive current controller comprising a control terminal, the control terminal receiving an intensity control input, the drive current controller configured to drive the light emitting element with an amount of electrical current based upon the intensity control input;

a voltage storage device comprising a first terminal and a second terminal electrically opposite the first terminal, the voltage storage device configured to be charged with a programmed voltage between the first terminal and the second terminal, the programming voltage representing a respective brightness to be emitted by the light emitting element, the first terminal being electrically coupled to the control terminal; and an intensity reduction input, electrically coupled to the second terminal, the intensity reduction input of each pixel being electrically coupled to respective intensity reduction inputs of other pixels within the plurality of pixels;

a bias generator configured to produce a bias voltage based on an amount of intensity reduction to be applied to each pixel within the plurality of pixels, the bias generator further configured to apply the bias voltage to the respective intensity reduction input of each of the plurality of pixels during an emission time interval to reduce an intensity of light emitted by the each pixel of the plurality of pixels during an emission time interval; and a conductive coupling, conductively coupling the bias voltage to each intensity reduction input of each pixel in the plurality of pixels.

* * * * *